US007694468B2

(12) United States Patent
Prince et al.

(10) Patent No.: US 7,694,468 B2
(45) Date of Patent: Apr. 13, 2010

(54) WINDOW FRAMING SYSTEM WITH DECORATIVE OVERLAY AND METHOD FOR USING THE SAME

(75) Inventors: Kendall W. Prince, Layton, UT (US); Matt A. Stott, Syracuse, UT (US)

(73) Assignee: Norman International, Inc., Santa Fe Springs, CA (US)

( * ) Notice: Subject to any disclaimer, the term of this patent is extended or adjusted under 35 U.S.C. 154(b) by 436 days.

(21) Appl. No.: 10/655,816

(22) Filed: Sep. 5, 2003

(65) Prior Publication Data

US 2005/0050814 A1 Mar. 10, 2005

(51) Int. Cl.
*E06B 5/10* (2006.01)

(52) U.S. Cl. ..... 52/204.55; 52/203; 52/213; 52/718.01; 52/743; 49/381; 49/493; 49/504

(58) Field of Classification Search ..... 52/211, 52/204.53, 204.66, 214, 473, 207, 213, 204.55, 52/718.01, 717.01, 717.06, 718.04, 745.06, 52/741.3, 203, 202; 49/67, 196, 56, 381, 49/463, 504

See application file for complete search history.

(56) References Cited

U.S. PATENT DOCUMENTS

| | | | | | |
|---|---|---|---|---|---|
| 1,202,990 | A | * | 10/1916 | Gill | 52/213 |
| 1,263,248 | A | * | 4/1918 | Hope | 49/62 |
| 1,913,313 | A | * | 6/1933 | Browne | 49/196 |
| 1,947,736 | A | | 2/1934 | Potter | |
| 2,578,470 | A | * | 12/1951 | Gorell et al. | 52/202 |
| 2,845,665 | A | * | 8/1958 | Place | 49/397 |
| 2,912,078 | A | | 11/1959 | Kiehl et al. | |
| 2,983,001 | A | | 5/1961 | Guldager | |
| 3,075,235 | A | * | 1/1963 | Albinson | 16/384 |
| 3,183,547 | A | * | 5/1965 | Bury | 16/238 |
| 3,245,124 | A | | 4/1966 | Faske | |
| 3,358,402 | A | * | 12/1967 | Sahm | 49/401 |
| 3,878,644 | A | * | 4/1975 | Brown et al. | 49/67 |
| 3,927,492 | A | * | 12/1975 | Carson | 49/141 |
| 4,160,343 | A | | 7/1979 | Hubbard | 49/90 |
| 4,175,357 | A | * | 11/1979 | Goldhaber | 49/395 |
| 4,196,545 | A | | 4/1980 | Korany et al. | |
| 4,226,066 | A | * | 10/1980 | Persson | 52/211 |
| 4,266,387 | A | * | 5/1981 | Karlsson | 52/731.3 |

(Continued)

OTHER PUBLICATIONS

Brochure: "Mason Ultragard Protection P.V.C. Protection, Casement Windows," Mason Windows Limited, 1987.

*Primary Examiner*—Phi Dieu Tran A
(74) *Attorney, Agent, or Firm*—David B. Tingey; Kirton & McConkie

(57) ABSTRACT

An aesthetically pleasing, slim profile window frame assembly that is capable of retaining a shutter. Specifically, the window frame assembly of the present invention comprises a core substrate coupled to a flange. Certain embodiments of the present invention comprise a core substrate having a thickness less than 5/16 inch and having, by volume, an elastic modulus greater than wood. A flange comprises a depth sufficient to retain a hinge attached to a window covering, such as a shutter. Certain embodiments of the present invention provide for a decorative covering to be coupled to the core substrate and/or flange such that a portion of the window frame assembly is thereby concealed. The improved strength per volume of the present invention facilitates shutter installation by a "do-it-yourself" homeowner or handyman as well as by a skilled carpenter.

15 Claims, 11 Drawing Sheets

U.S. PATENT DOCUMENTS 4,328,650 A 5/1982 Garbell
4,339,901 A * 7/1982 Hubbard ..... 52/202
4,407,100 A 10/1983 Huelsekopf
4,430,831 A 2/1984 Kemp
4,599,836 A * 7/1986 Melcher ..... 52/202
4,663,885 A * 5/1987 Stibolt ..... 49/67
4,811,533 A 3/1989 Wetsel
4,875,318 A * 10/1989 MacLeod et al. ..... 52/211
4,886,103 A * 12/1989 Baier ..... 160/178.1 R
4,974,366 A * 12/1990 Tizzoni ..... 49/504
4,982,530 A * 1/1991 Palmer ..... 49/504
5,148,649 A 9/1992 Cipriano
5,230,738 A * 7/1993 Wheeler ..... 118/504
5,390,454 A 2/1995 Coddens
5,419,085 A 5/1995 Imbur ..... 49/398
5,423,149 A * 6/1995 Herbst ..... 49/382
5,490,353 A * 2/1996 McLaughlin ..... 49/64
5,599,051 A 2/1997 Bourgeois ..... 292/262
5,623,783 A * 4/1997 Kenkel ..... 49/21
5,809,617 A * 9/1998 Harris et al. ..... 16/273
5,857,298 A 1/1999 Fullwood ..... 52/202
5,865,562 A 2/1999 Mallek ..... 403/403
5,893,600 A * 4/1999 McManus ..... 296/146.16
5,901,511 A 5/1999 Yoshida
5,913,786 A 6/1999 Mayer
6,141,922 A 11/2000 Carlisle
6,212,835 B1 4/2001 Schiedegger et al.
6,223,484 B1 * 5/2001 Minter ..... 52/213
6,257,301 B1 7/2001 Conforti
6,276,101 B1 8/2001 Schiedegger et al.
6,385,927 B2 5/2002 Schiedegger et al.
6,389,763 B1 5/2002 Clauss
6,474,034 B1 * 11/2002 Dronigi ..... 52/473
6,474,038 B2 11/2002 Nien et al. ..... 52/717.01
6,505,669 B2 * 1/2003 Lilie et al. ..... 160/371
6,588,159 B1 * 7/2003 Cotton, Jr. ..... 52/211
6,745,523 B2 6/2004 Petta
6,938,665 B2 * 9/2005 Lewis et al. ..... 160/96
2002/0121067 A1 * 9/2002 Nien et al. ..... 52/717.01
2003/0041539 A1 3/2003 Bernacki et al.
2004/0003554 A1 1/2004 Beaudoin et al.
2006/0037260 A1 2/2006 Prince et al.
2007/0125013 A1 6/2007 Prince

* cited by examiner

WINDOW FRAMING SYSTEM WITH DECORATIVE OVERLAY AND METHOD FOR USING THE SAME

BACKGROUND OF THE INVENTION

1. Field of the Invention

The present invention relates to an interior window frame assembly, and more particularly to an aesthetically pleasing interior window frame assembly for anchoring an interior window shutter thereto.

2. Background and Related Art

Window coverings such as shades, blinds and shutters are commonly used to provide privacy in a room as well as to block or reduce incoming sunlight. Window shutters are particularly popular as they provide maximum privacy, versatility, durability and ease of use. Window shutters may be constructed from a variety of materials, although the most commonly used material is wood and/or composites, finished either with a traditional wood finish, paint or by a coating of plastic or other substance.

Regardless of the material used to construct window shutters, window shutters are typically heavier and more cumbersome than other types of window coverings. Accordingly, proper installation and use of durable supporting frames and hardware are critical to ensure that shutters do not detach upon repeated use.

Traditionally, wood or wood composite window frames have been implemented for this purpose. Although the type of wood used in frame construction may vary, wood frames are typically soft and bulky as they require a considerable amount of surface area to provide the degree of elasticity and strength needed to properly support the weight of an attached shutter. These characteristics make frame handling and installation difficult, and labor expensive.

Wood frames are especially difficult to implement where there is a preexisting window molding or irregularities in the dimensions of a window opening. Those skilled in the art have traditionally dealt with this problem by trimming and/or caulking a window frame to accommodate such irregularities. This solution, however, is both time consuming and inexact. Indeed, if a window frame is improperly trimmed or installed out of square with the window opening, it may not be able to support the weight of an attached window covering. Wood frames are also prone to warp, thus further compromising the frame's strength and squareness with respect to a window.

Further, a standard window frame that has become strained or deformed due to warping or improper positioning may fail to accommodate a standard size window covering. A window covering must then be customized to accommodate the proportions of the window frame. Alternatively, the window frame must be replaced, repositioned and/or re-secured as necessary to retain and support a standard window covering in square with the window opening.

These inherent characteristics and difficulties of window frame and shutter installation require considerable time and labor of even highly skilled carpenters. When a layman attempts shutter installation, window frame and shutter installation can be dangerous as well. Improper window frame and shutter installation, or use of materials in window framing that are inadequate to support the weight of a shutter may cause the shutter to detach, thereby increasing a likelihood of damage to property and/or personal injury.

Accordingly, what is needed is an aesthetically pleasing window frame assembly capable of easy installation by those with a minimum of carpentry knowledge. What is also needed is a lightweight, slim profile window frame assembly that may be easily implemented in connection with a preexisting window molding. Further what is needed is a window frame assembly that maintains squareness with a window over time. Finally what is needed is a window frame assembly that compensates for irregularities in the dimensions of the window opening such that the window frame may predictably and reliably accommodate a standard window covering.

The present invention overcomes the foregoing and other disadvantages of the prior art by providing a novel and improved window frame assembly.

SUMMARY OF THE INVENTION

The present invention is an aesthetically pleasing, slim profile window frame assembly that is capable of retaining a shutter. Specifically, the window frame assembly of the present invention comprises a core substrate coupled to a flange. Certain embodiments of the present invention comprise a core substrate having a thickness less than 5/16 inch (7.9 mm) and having, by volume, an elastic modulus greater than wood. A flange comprises a depth sufficient to retain a hinge attached to a window covering, such as a shutter. Certain embodiments of the present invention provide for a decorative covering to be coupled to the core substrate and/or flange such that a portion of the window frame assembly is thereby concealed. A decorative covering may comprise wood, wood veneer, plastic, cloth and/or paint. The improved strength per volume of the present invention facilitates shutter installation by a "do-it-yourself" homeowner or handyman as well as by a skilled carpenter.

An object of the present invention is to provide an aesthetically pleasing window frame assembly capable of easy installation by a person with a minimum of carpentry knowledge.

Another object of the present invention is to provide a lightweight, slim profile window frame assembly that may be easily implemented in connection with a preexisting window molding.

It is a further object of the present invention to provide a window frame assembly that maintains squareness with respect to a window opening upon installation and over time.

A further object of the present invention is to provide a window frame assembly that compensates for irregularities in the dimensions of the window opening such that the window frame assembly may predictably and reliably accommodate a standard window covering.

These and other features and advantages of the present invention will be set forth or will become more fully apparent in the description that follows. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

As used in this specification, the term "window covering" refers to any shutter, blind, shade or any other window covering known to those in the art capable of being supported and/or retained by the window frame assembly described herein. The term "window jamb" refers to the supporting wall structure perpendicularly adjoining an outer edge of an installed window. The term "adjacent wall" indicates the supporting wall structure adjoining, generally at a substantially right angle, a window jamb at an edge opposite the edge adjacent a window. The terms "mounting hardware" and "hardware" refer to any hardware or combination of hardware capable of retaining the window frame assembly of the present invention against a window jamb or adjacent wall, including, but not limited to, screws, bolts, rivets, nails, staples, adhesives and cement. "Elasticity" refers to a property of a material in which strains or deformations are recoverable after an applied stress is removed. The term "modulus of elasticity" or "elastic modulus" is the ratio of stress to strain, measured in pounds per square inch (psi). Values corresponding to a modulus of elasticity, abbreviated herein as "E," are given in terms of million psi. Thus, a board with a modulus of elasticity of 2,100,000 psi may be reported as 2.1 E.

Figure 1:
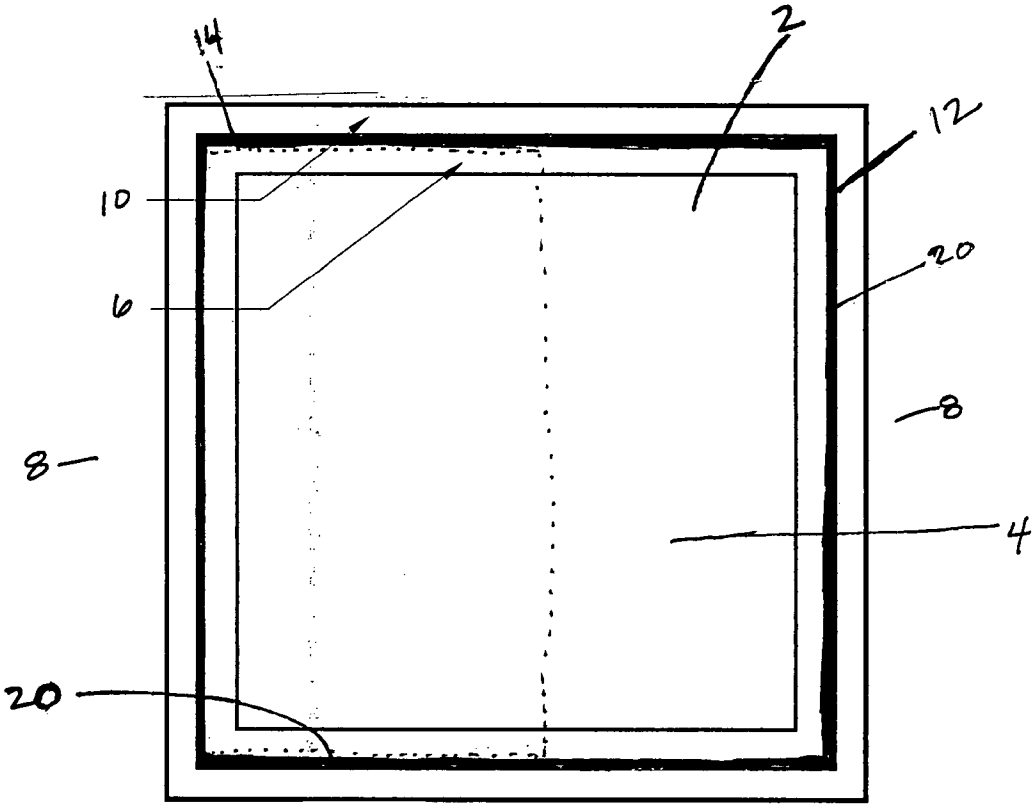
FIG. 1 is a perspective view of a window opening within a rigid wall structure configured to receive a window frame assembly in accordance with the present invention.

The present invention comprises a window frame assembly to facilitate the installation of a window covering 14 to cover an interior window 2. Referring to FIG. 1, an interior window 2 comprises a window surface 4, an associated window jamb 6, an adjacent wall 8 and an edge 12 common to the window jamb 6 and adjacent wall 8. A preexisting window molding 10 may frame a window 2 proximate the common edge 12. If, however, a window 2 does not employ a preexisting window molding 10, the present invention contemplates such a molding 10 as an element of selected embodiments of the present invention.

Figure 2:
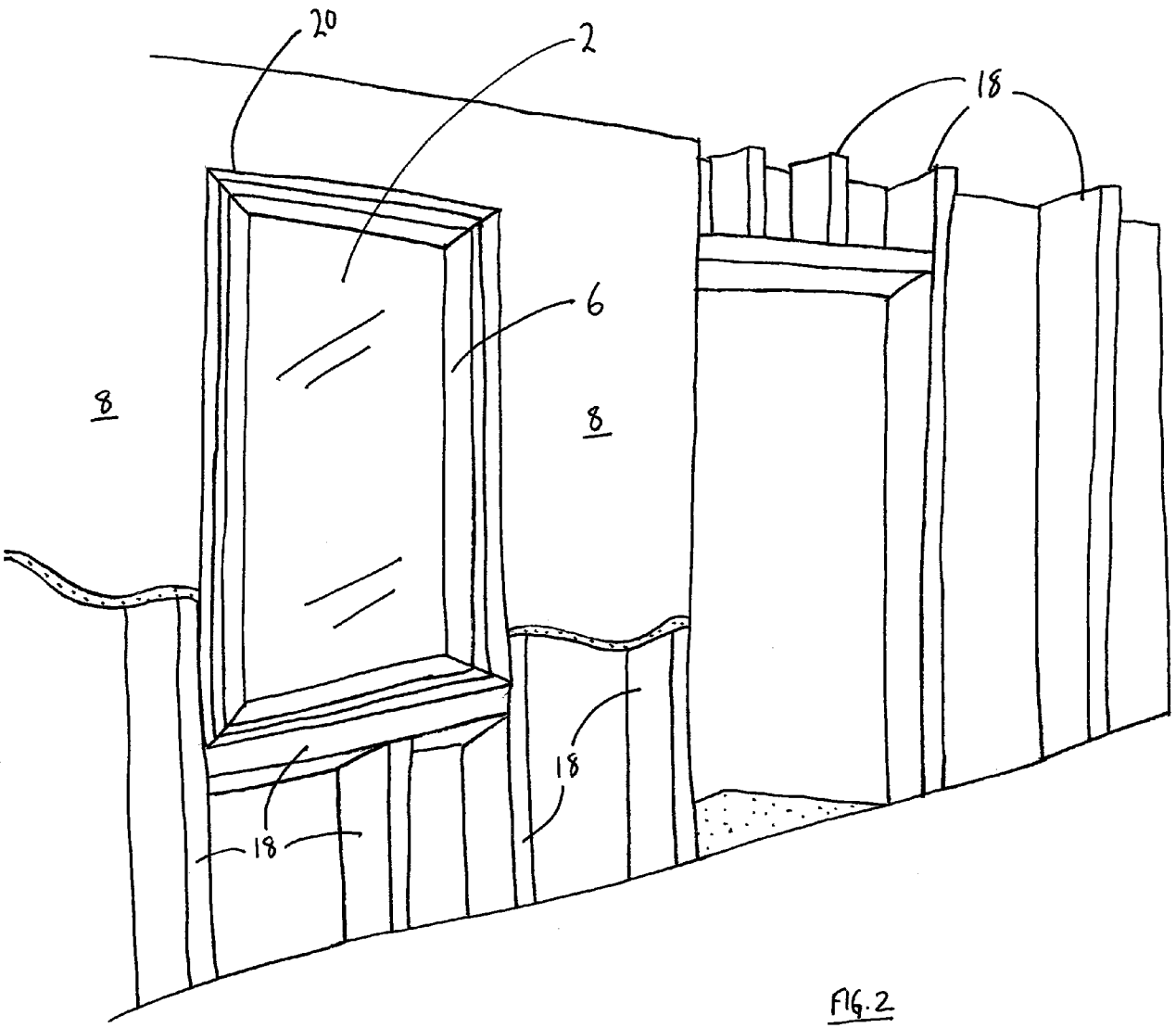
FIG. 2 is a perspective cut-away view of the perspective view of FIG. 1, showing the internal wall members in relation to the overall wall structure and window opening, as well as in relation to the window frame assembly of the present invention.
Figure 7:
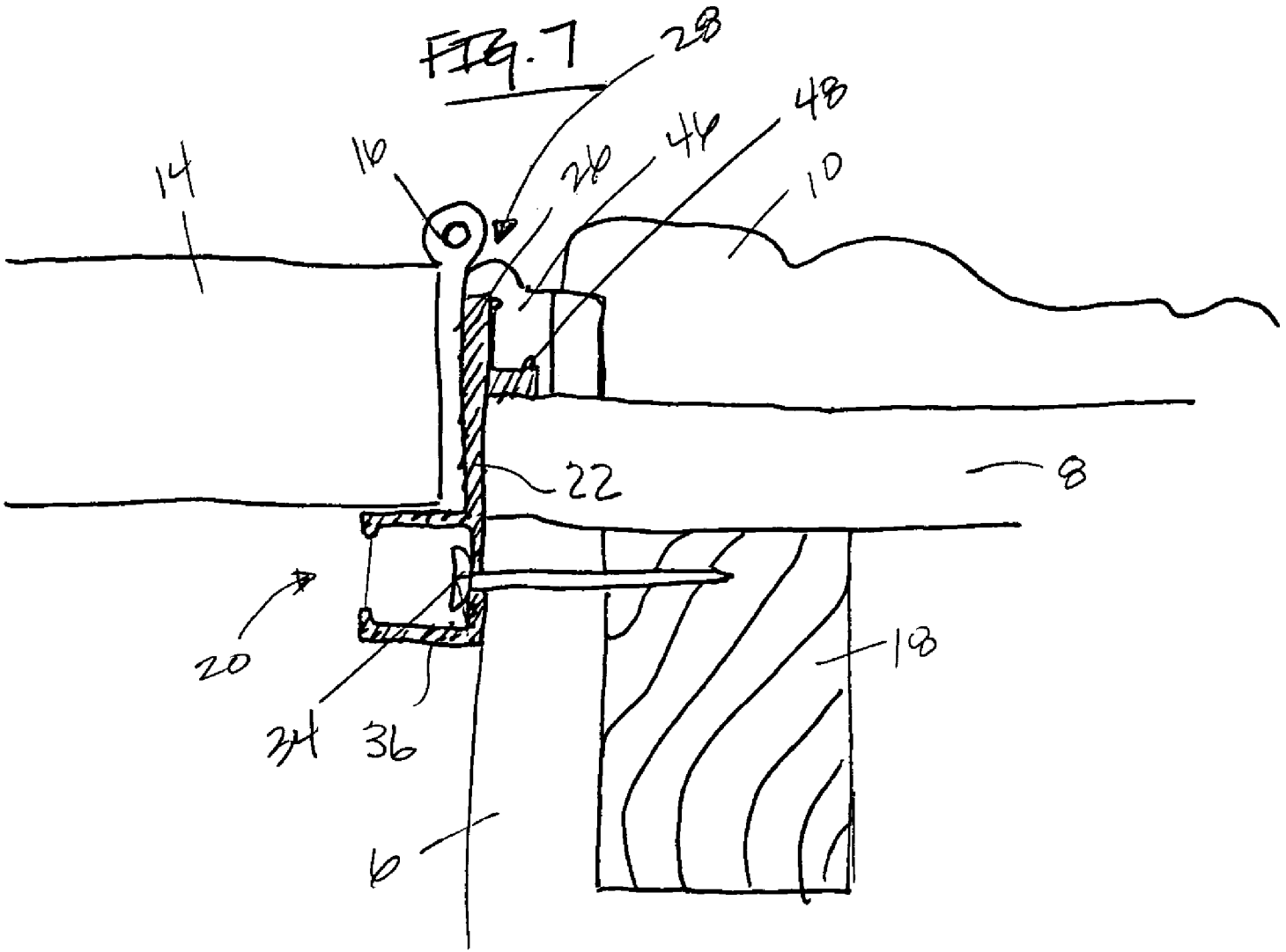
FIG. 7 is a cross-sectional view of a core substrate, flange and decorative covering in accordance with a first embodiment of the present invention.

FIG. 2 provides a perspective cut-away view of the elements of FIG. 1. Particularly, FIG. 2 depicts internal wall stud members 18 in relation to an overall wall structure and window opening 2, as well as in relation to the window covering frame assembly of the present invention. The window covering frame assembly of the present invention may be secured to a window jamb 6 or to an adjacent wall 8 by mounting hardware, or by any other means known to those skilled in the art. Preferably, as depicted in FIG. 7, an industrial screw 34 is driven through a core substrate 20 into a window jamb 6 or adjacent wall 8, and further into an internal stud member 18. This securing technique ensures proper attachment and reliability of the window frame assembly over time. Similarly, it is also preferred to secure a core substrate 20 at relatively small intervals along a window jamb 6 or adjacent wall 8 to provide additional support for the window frame assembly and attached window covering thereby retained.

Figure 3:
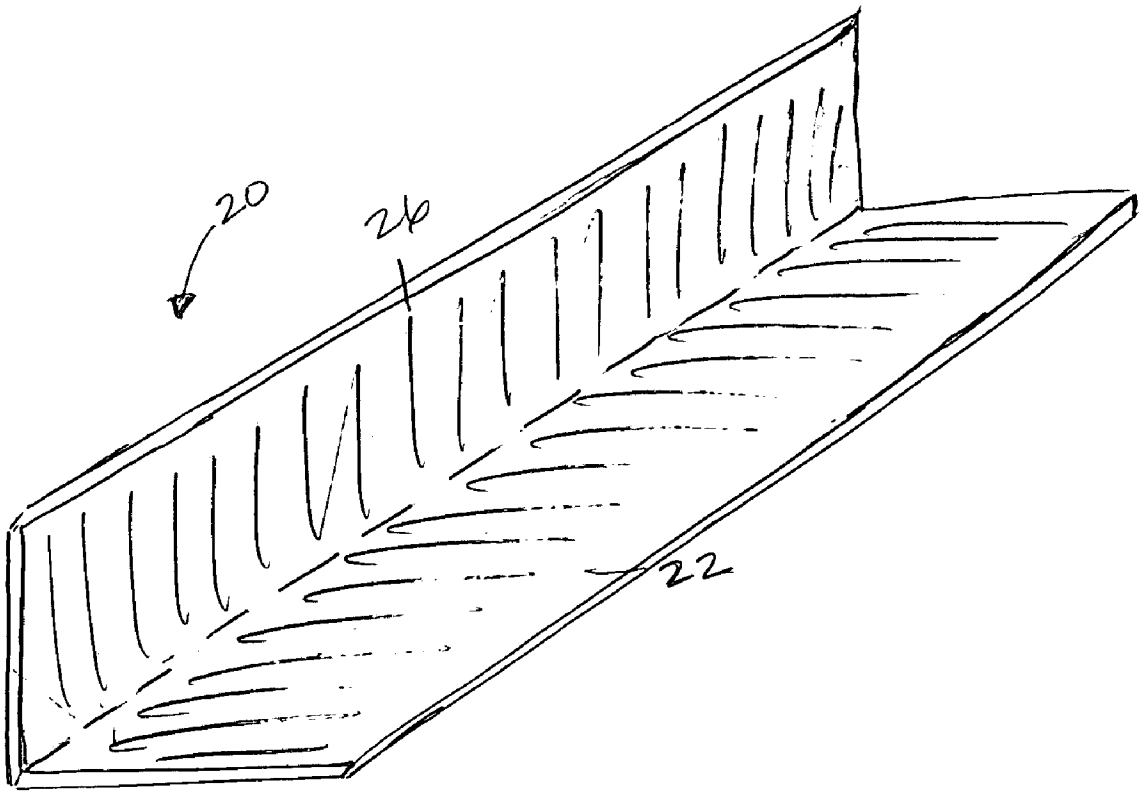
FIG. 3 is a cross-sectional perspective view of a first embodiment of the core substrate and flange of the present invention.
Figure 4:
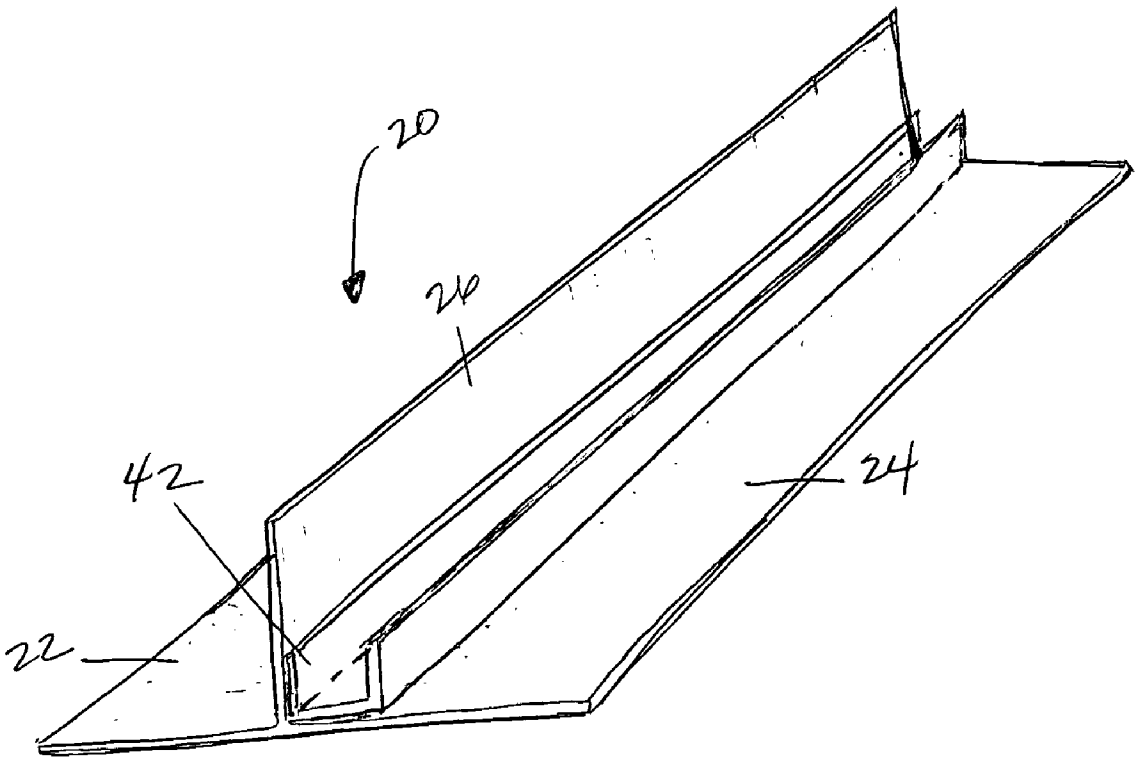
FIG. 4 is a cross-sectional perspective view of a second embodiment of the core substrate and flange of the present invention.
Figure 5:
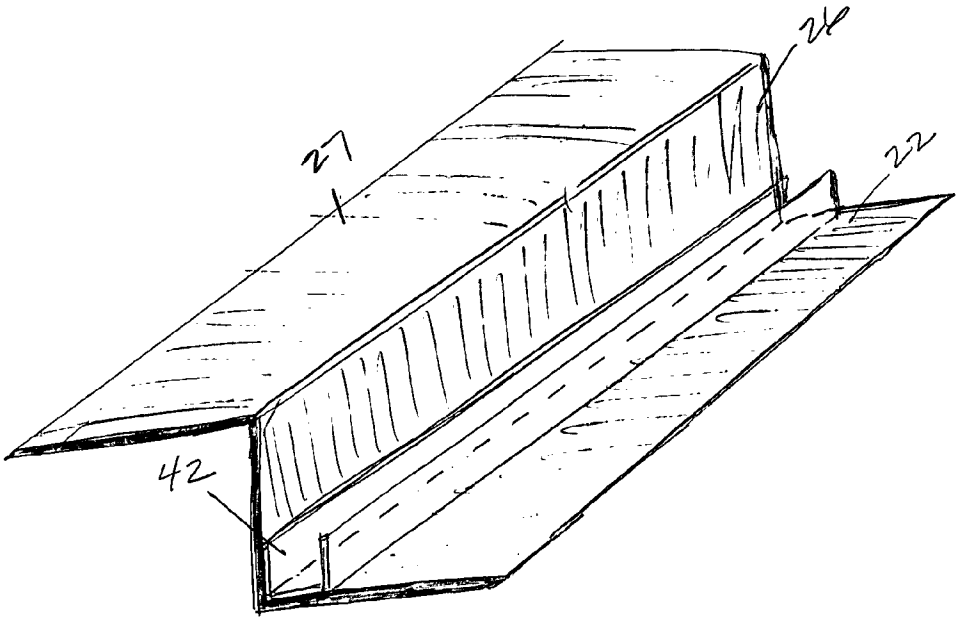
FIG. 5 is a cross-sectional perspective view of a third embodiment of the core substrate and flange of the present invention.

Referring now to FIGS. 3-5, selected embodiments of the present invention comprise a core substrate 20, wherein the core substrate 20 comprises fiberglass, aluminum, graphite, reinforced plastic, or any other metal or material, or combination thereof, recognized by those skilled in the art as capable of both having a slim profile and having an elastic modulus sufficient to retain an interior window covering 14 (see FIG. 7). A core substrate 20 further comprises an elongate lateral plate 22 having a perpendicularly attached flange 26. Preferably, a thickness corresponding to each of the lateral plate 22 and the attached flange comprises less than 5/16 inch (7.9 mm). Such a slim profile enables the window frame assembly of the present invention to be implemented in a variety of window openings 2 without interfering with the dimensions of the window opening 2 or with a preexisting window molding 10 in close proximity to the window opening 2. In addition, the slim profile aspect of the present invention enables the window frame assembly to be transported and installed with minimal expense and labor.

A slim profile core substrate 20 preferably comprises a high degree of elasticity to facilitate its ability to retain an interior window covering 14 over time. Indeed, a relatively inelastic substrate requires relatively greater mass to retain any given window covering 14. Although most presently known window frame assemblies are made of wood, wood is not preferred for use in the present invention due to its characteristically low elasticity. An elastic modulus value for wood varies according to the species of wood. For example, Eastern Red Cedar is very soft softwood having an elastic modulus of 0.88 E. Pignut Hickory, on the other hand, is one of the strongest hardwoods, having an elastic modulus of 2.26 E. As one particularly desirable feature of the window frame assembly of the present invention is its slim profile, the core substrate of the present invention 20 comprises an elastic modulus greater than wood, preferably greater than 2.3 E. In this manner, the core substrate 20 of the present invention may comprise a thickness of less than 5/16 inch without compromising its structural integrity or the security of the interior window covering 14 thereby retained.

Referring now to FIG. 3, a core substrate 20 may comprise a variety of cross-sectional configurations depending on the conditions, features and desired effects for a particular window opening 2. Specifically, where a window opening 2 has a preexisting window molding 10 closely aligned with the common edge 12, it may be desirable to implement a core substrate 20 and associated flange 26, wherein the cross-sectional shape of the integrally formed or attached substrate 20 and flange 26 resemble an "L." A flange 26 preferably comprises a width sufficient to retain a hinge 16 pivotably attached to a window covering 14. An elongate lateral plate 22 of the core substrate 20 may be attached to a window jamb 6 or adjacent wall 8 by mounting hardware or by any other means known to those in the art. According to this embodiment of the present invention, the rigidity of the elongate lateral plate 22 enables the plate 22 to be attached to the window jamb 6 or adjacent wall 8 in such a manner that the plate 22 is parallel the window opening 2, despite variances in the drywall, paint or other subsequently applied wall applications. In addition, the elongate lateral plate 22 may implement a connecting channel 42 (see FIG. 4) along its length that may be connected to a perpendicularly oriented connecting channel 42 along a second elongate lateral plate 22 to form the window frame assembly of the present invention. In this manner, the window frame assembly of the present invention ensures squareness with respect to the window opening 2. This aspect of the present invention is discussed in more detail with reference to FIGS. 11 and 12 below. This embodiment of the present invention may also implement any one of a variety of decorative coverings 28 to conceal any void between the window frame assembly and existing window molding 10, as discussed in detail with reference to FIGS. 6-9 below.

Referring now to FIG. 4, certain alternative embodiments of the present invention comprise a core substrate 20 and a flange 26 integrally formed or attached to resemble, in cross-section, the shape of a "T". According to such embodiments, the elongate lateral plate 22 of the core substrate 20 extends beyond the position of the flange 26 to create an extended edge 24. The extended edge 24 may function to conceal and/or correct irregularities in the common edge 12, as well as to retain a decorative covering 28. A decorative covering 28 may comprise wood, plastic, paint, or any other material known to those in the art by which to substantially conceal an exposed portion of the core substrate 20 and/or enhance the appearance of the window opening 2. Specifically, where a window opening 2 does not have a preexisting window molding 10, the present invention contemplates implementing a window molding 10 as a decorative covering 28 attached to the core substrate 20 to substantially conceal the core substrate 20 as well as to enhance the overall appearance of the window opening 2.

Like the embodiment of the present invention depicted as FIG. 3 above, the "T"-shaped embodiment of FIG. 4 implements a flange 26 wide enough to accommodate a hinge 16 pivotably attached to a window covering 14, such as a shutter. The embodiment of FIG. 4 may also incorporate a connecting channel 42 aligned with the elongate lateral plate 22 to facilitate adjoining adjacent perpendicularly oriented lateral plates 22 to form a frame assembly in square with a window opening 2.

Referring now to FIG. 5, a core substrate 20 in accordance with the present invention may comprise a flange 26 perpendicularly disposed between two elongate lateral plates 22 and 27 on parallel planes such that a cross-sectional profile of the frame assembly thus formed resembles the shape of a "Z." According to this embodiment of the present invention, like other embodiments previously discussed, the flange 26 comprises a width sufficient to accommodate a hinge 16 pivotably attached to a window covering 14, such as a shutter. Further, an elongate lateral plate 22 may comprise a connecting channel 42 longitudinally disposed thereon to facilitate frame assembly as discussed above. Specifically, a corner bracket may be implemented to adjoin the connecting channel 42 of a first elongate lateral plate 22 to a perpendicularly oriented connecting channel 42 of a second elongate lateral plate. The "Z" orientation of the present embodiment enables the window covering to be mounted inside the window opening 2 while enabling a peripheral elongate lateral plate 27 to conceal and/or correct irregularities in the corner edge 12. Further, the peripheral elongate lateral plate 27 may function to retain a decorative covering 28 of the user's choice.

Figure 6:
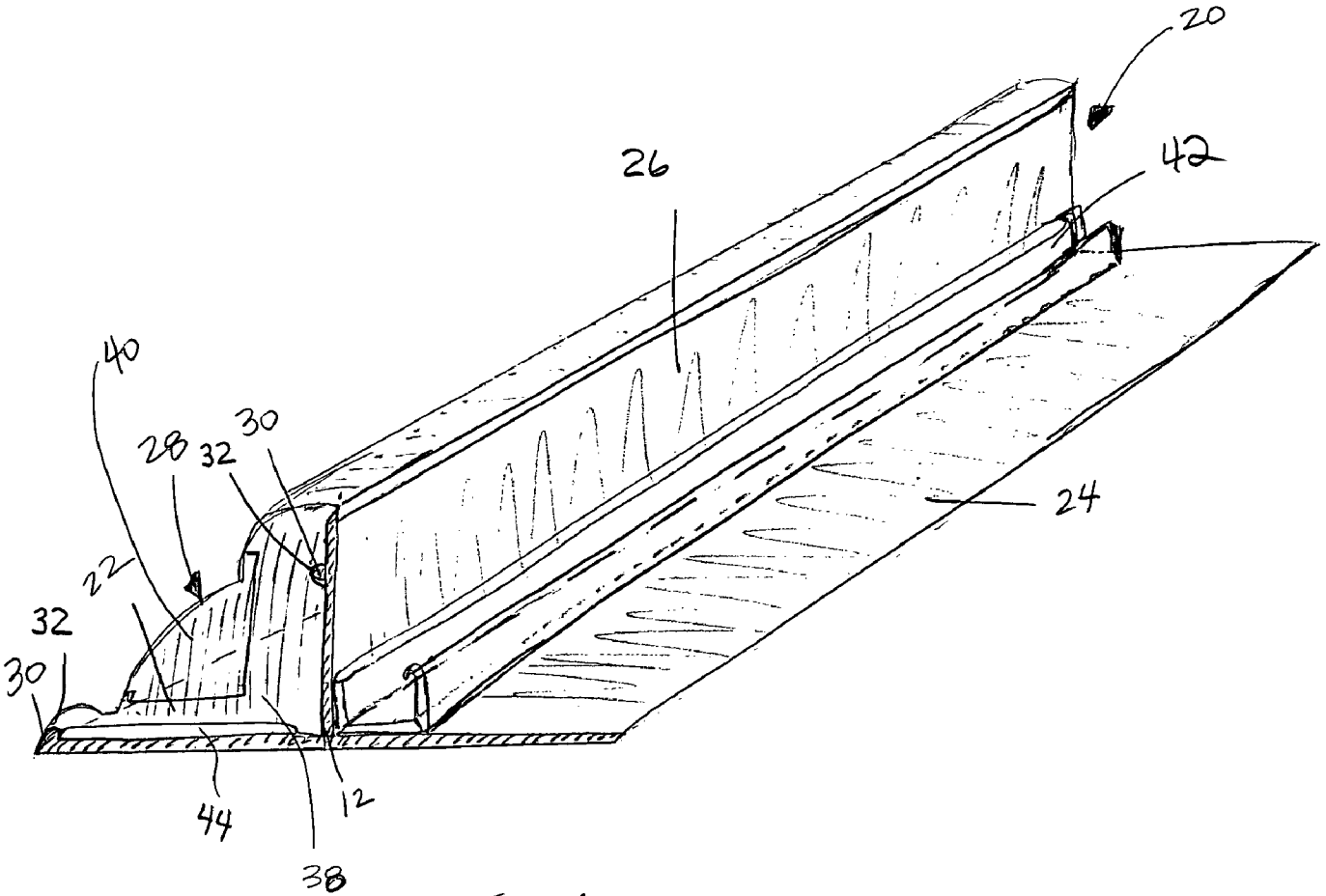
FIG. 6 is a cross-sectional perspective view of a core substrate, flange and decorative covering in accordance with selected embodiments of the present invention.

Referring now to FIG. 6, a core substrate 20 and/or flange 26 may incorporate one or more retaining tabs 30 to receive a decorative covering 28. A decorative covering 28 preferably comprises wood or wood composite decoration resembling a traditional wood molding. Unlike a traditional wood molding, however, the decorative covering 28 may incorporate notches 32 corresponding to retaining tabs 30 provided in the core substrate 20. The decorative covering 28 may be attached to the core substrate 20 by aligning the notches 32 with the retaining tabs 30 and pressing the decorative covering 28 against the core substrate 20 to ensure a press fit.

Alternatively, a decorative covering 28 may be retained against a core substrate 20 by traditional fastening means, including but not limited to mounting hardware and/or any other fastening means known to those in the art. A decorative covering 28 may further employ a channel 44 within its underside surface to accommodate any portion of a screw or other hardware that may project from the wall subsequent to its use in securing a core substrate 20 in place.

In addition, a decorative covering 28 may comprise a plurality of interlocking components. By way of example and not limitation, the decorative covering 28 may comprise a frame base 38 and a concealing strip 40, where the frame base 38 may further comprise a groove configured to retain a tongue of the concealing strip 40. When the concealing strip 40 is properly disposed into the frame base 38, the two components form a locking tongue and groove junction, thereby concealing any hardware used to affix the decorative covering 28 to an adjacent wall 8. Further, where the frame base 38 is properly positioned in relation to a core substrate 20, a screw or other mounting hardware known to those in the art may be driven through both the frame base 38 and the core substrate 20 to affix both to an adjacent wall 8. A concealing strip 40 may then be disposed into the frame base 38 to conceal such screw or other mounting hardware.

Referring now to FIG. 7, a core substrate 20 may incorporate a hardware concealing channel 36 into an elongate lateral plate 22 to facilitate installation of the window frame assembly of the present invention. The hardware concealing channel 36 may be premarked or predrilled to receive a screw 34 or other mounting hardware, wherein such screw 34 ultimately engages an internal stud member 18 to ensure that the window frame assembly and attached window covering securely attach to the window opening 2.

According to one aspect of the embodiment of the present invention depicted by FIG. 7, a decorative covering 28 may comprise a substantially rigid insert 46 having dimensions appropriate to accommodate any void resulting between a preexisting window molding 10 and the window frame assembly when the window frame assembly is properly installed in square with the window opening 2. Such an insert 46 may comprise wood, plastic or any other material known to those in the art capable of decoratively concealing a gap otherwise existing between the window frame assembly and a window molding 10. According to this aspect of the present invention, a recess may be longitudinally disposed along the depth of the window molding 10 to retain a portion of the insert 36 therein. The core substrate 20 and/or flange 26 may also implement an insert engaging piece 48 to further secure the insert 46 in a substantially fixed position relative to the window frame assembly and preexisting window molding 10.

Figure 8:
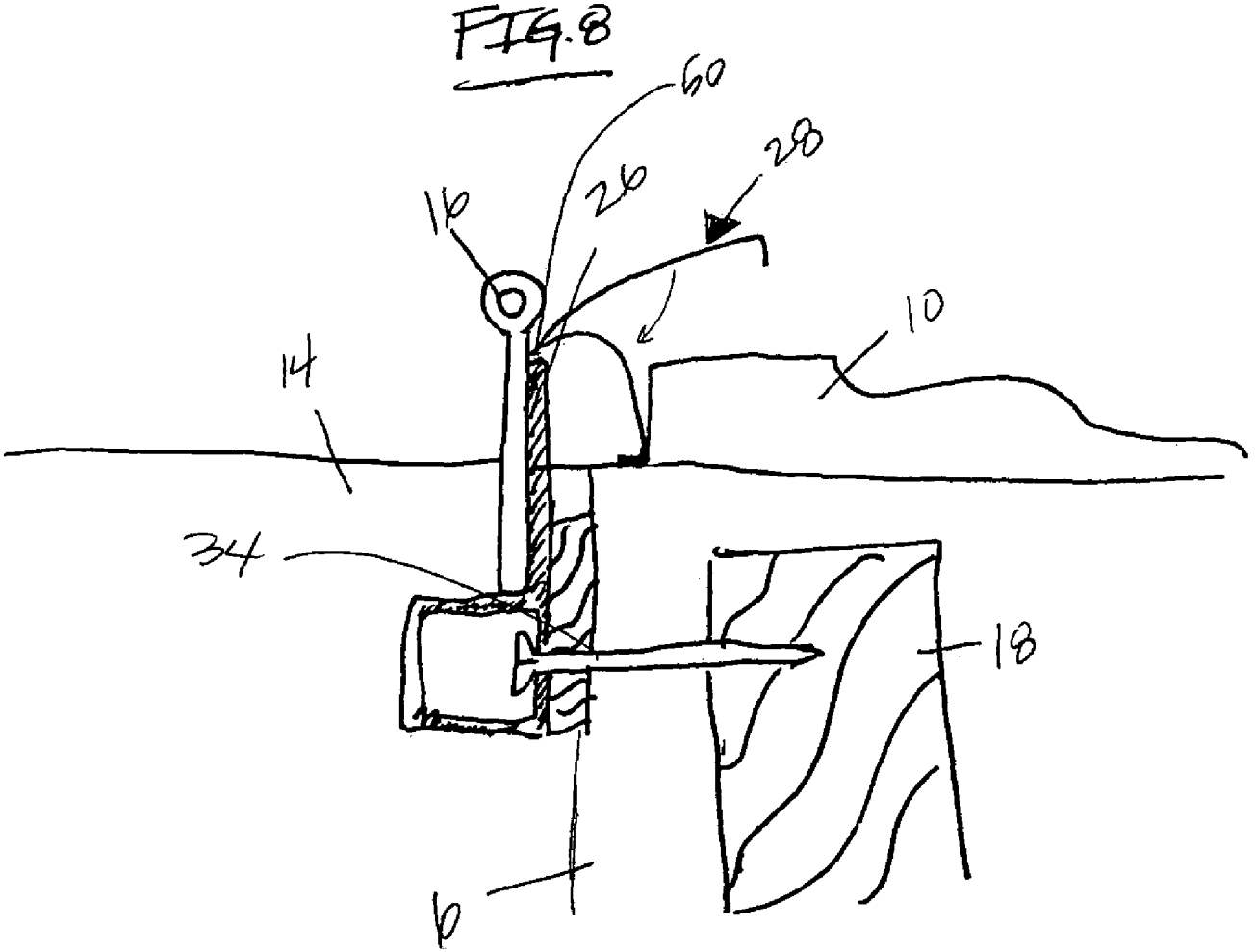
FIG. 8 is a cross-sectional view of a core substrate, flange and decorative covering in accordance with a second embodiment of the present invention.

Referring to FIG. 8, it is not uncommon to witness substantial variation in the dimensions of voids existing between the window frame assembly and a preexisting window molding 10 along a length of a window opening 2. A deformable material capable of accommodating such variation is thus preferred. According to certain embodiments of the present invention, a decorative covering 28 comprises a deformable material including, but not limited to, foam rubber, flexible plastic or composite fill, which functions to substantially conceal any gap otherwise present between the window frame assembly and a window molding 10.

In selected embodiments, a decorative covering 28 comprises deformable plastic. According to this embodiment of the present invention, an edge of a plastic strip 50 attaches to an externally exposed surface of the flange 26 at a point beyond the common edge 12. The plastic strip 50 may be provided having a width sufficient to enable the plastic strip 50 to be substantially retained in either a flexed or relaxed state between the flange 26 and a window molding 10 to substantially conceal a uniform or non-uniform gap otherwise existing therebetween.

Figure 9:
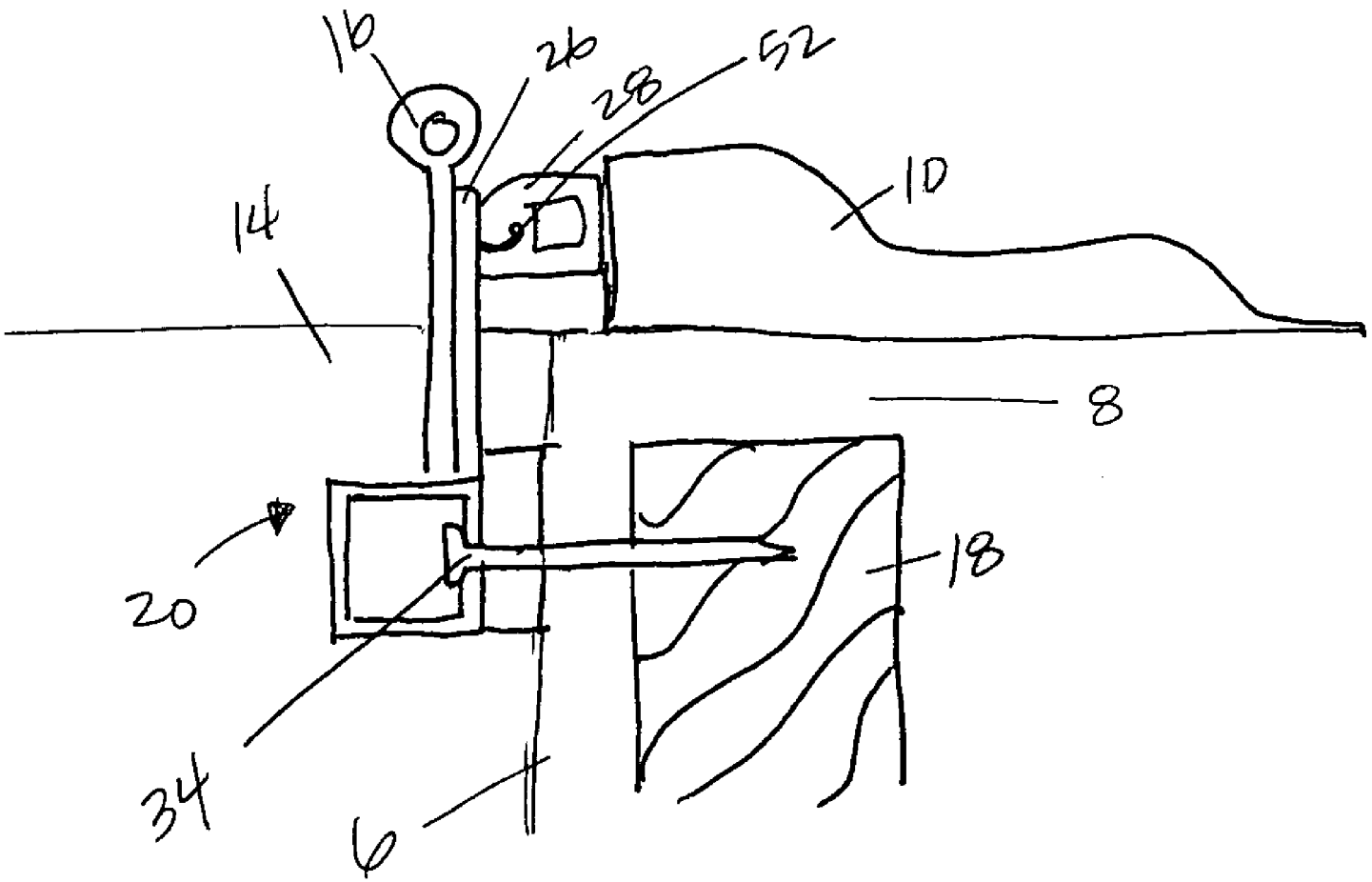
FIG. 9 is a cross-sectional view of a core substrate, flange and decorative covering in accordance with a third embodiment of the present invention.

Referring now to FIG. 9, a decorative covering 28 may alternatively be implemented as a deformable and substantially resilient material such as foam rubber. Such a decorative covering 28 may optionally comprise a hollow channel to enhance its resiliency. According to one aspect of the present embodiment of the present invention, a window frame assembly may further comprise an engaging member 52 affixed to an externally exposed surface of the attached flange 26. Alternatively, the engaging member 52 may be integrally formed with the flange 26. In selected embodiments, the decorative covering 28 comprises an aperture conforming to the engaging member 52 such that the engaging member 52 effectively retains the decorative covering 28 in a substantially fixed position relative to the flange 26.

Figure 10:
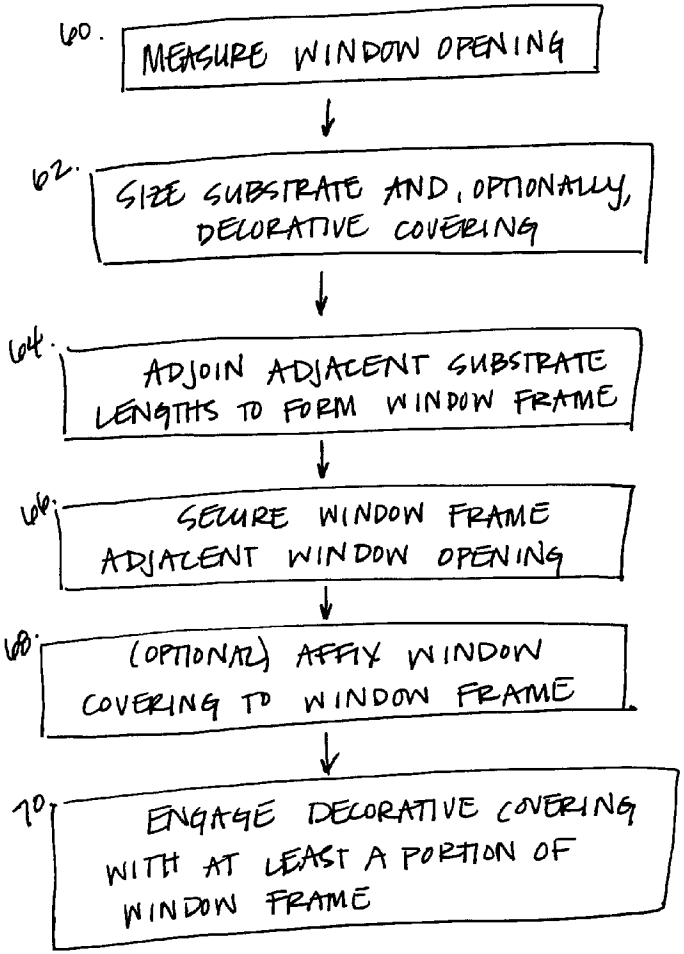
FIG. 10 is a flow chart delineating the steps for the method of installing the window frame assembly of the present invention.

Referring now to FIG. 10, a method for installing the window frame assembly of the present invention may depend on whether the subject window opening 2 bears industry standard dimensions. If the answer is yes, it will likely be possible to purchase a window frame assembly pre-sized to accommodate the subject window opening 2, thus circumventing steps one and two of the present method. If the window is irregularly shaped or bears unique dimensions, on the other hand, the first step for installing the window frame assembly of the present invention may be to measure the window opening dimensions 60, after which a core substrate and decorative covering may be appropriately sized 62. The third step comprises substantially adjoining adjacent core substrates 64 to form a window frame. This step may be accomplished by any means known in the art, including, but not limited to, mitering and bracketing abutting edges. In addition, the third step 64 may be facilitated by connecting channels 42 longitudinally disposed along each elongate lateral plate 22, as discussed above. A fourth step comprises securing the window frame adjacent a window opening 66 such that the window frame is substantially in square with the window opening. An optional fifth step 68 provides for affixing a shutter or other window covering to at least a portion of the window frame such that the window covering may be substantially retained thereby. A final step 70 contemplates engaging a decorative covering with at least a portion of the window frame such that the decorative covering may be retained substantially adjacent an adjacent wall and proximate a window opening.

Figure 11:
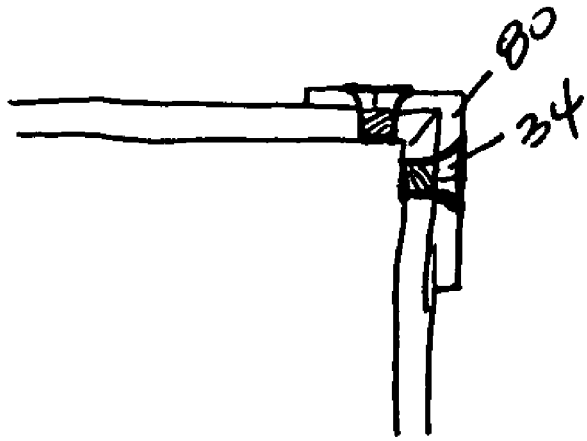
FIG. 11 is a cut-away view of a method for adjoining perpendicular sections of a window frame in accordance with the present invention.

Referring to FIG. 11, an external bracket 80 may be used to join and reinforce a mitered joint between lengths of a window frame assembly, as discussed above with reference to the third step of the method of FIG. 10. The external bracket 80 may be attached to each decorative covering 28 and/or core substrate 20 and flange 26 forming the mitered joint using one or more screws or other suitable means of attachment such as rivets, bolts and the like. In certain embodiments, flat head screws that sit flush with the surface of the external bracket 80 may be used.

Figure 12:
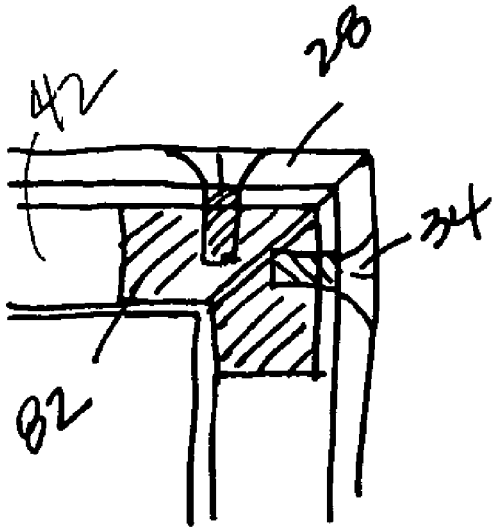
FIG. 12 is a cut-away view of an alternative method for adjoining perpendicular sections of a window frame in accordance with the present invention.

Referring to FIG. 12, in certain embodiments an internal bracket 82 may be used to reinforce and join a mitered joint between lengths of a window frame assembly. For example, as discussed above, an elongate lateral plate 22 may incorporate a connecting channel 42 longitudinally disposed thereon. An internal bracket 82 may then be affixed to each of two perpendicularly oriented connecting channels 42 disposed upon adjacent lengths of window frame to secure the associated core substrates 20 and/or brackets 26 in square. Screws or other attachment means may extend through any decorative coverings 28 into the internal bracket 82 to further ensure a fixed relationship between adjacent decorative coverings 28.

What is claimed is:

1. An interior window covering frame assembly comprising:

a windowpane generally positioned within an opening of a wall in a first plane;

an elongate core substrate having a thickness of less than 5/16 inch, said elongate core substrate having an elongate lateral plate and a flange perpendicularly coupled to said lateral plate, the flange intersecting the elongate lateral plate to provide a first portion and a second portion to provide a cross-sectional t-shape, wherein the first and second portions are generally in the same plane, and wherein said elongate lateral plate is directly coupled to an interior facing wall surface having a second plane that is substantially parallel to the first plane of the windowpane, said elongate lateral plate being directly coupled to the interior facing wall surface in the second plane, and the flange extending outwardly from the elongate lateral plate in a third plane that is substantially perpendicular to both the first plane and the second plane;

a connecting channel directly coupled to at least one of a first face of said flange and said first portion of said lateral plate;

a window covering directly coupled to said first face of said flange, wherein said window covering is capable of substantially covering said windowpane; and a decorative covering abutting at least one of a second face of said flange and said second portion of said lateral plate.

2. The interior window covering frame assembly of claim 1, wherein said substrate comprises at least one material having an elastic modulus greater than 2.3 E.

3. The interior window covering frame assembly of claim 1, wherein said substrate is formed of material selected from the group consisting of fiberglass, metal, graphite and reinforced plastic.

4. The interior window covering frame assembly of claim 1, further comprising a hinge coupled to said first face of said flange.

5. The interior window covering frame assembly of claim 1, wherein said decorative covering comprises a material selected from the group consisting of wood, plastic, wood composite, cloth and paint.

6. The interior window covering frame assembly of claim 1, wherein said window covering comprises a shutter.

7. An interior window covering frame assembly for entirely framing an interior facing of a window opening, the assembly comprising:

a windowpane generally positioned within the window opening in a first plane;

an elongate core substrate having an elastic modulus greater than 2.3 E, said elongate core substrate having an elongate lateral plate and a flange perpendicularly coupled to said lateral plate, the flange intersecting said elongate lateral plate to provide a first portion and a second portion to provide a cross-sectional t-shape, wherein the first and second portions are generally in the same plane, and wherein said elongate lateral plate is directly coupled to an interior facing wall surface having a second plane that is substantially parallel to the first plane of the windowpane, said elongate lateral plate being directly coupled to the interior facing wall surface in the second plane, and the flange extending outwardly from the elongate lateral plate in a third plane that is substantially perpendicular to both the first plane and the second plane;

a connecting channel directly coupled to at least one of the second portion of said lateral plate and a first portion of said flange;

a window covering directly coupled to a second portion of said flange, wherein said window covering is capable of substantially covering said windowpane; and a decorative covering abutting at least one of a second portion of said lateral plate and said flange.

8. The interior window covering frame assembly of claim 7, wherein said substrate is formed of material selected from the group consisting of fiberglass, metal, graphite and reinforced plastic.

9. The interior window covering frame assembly of claim 7, wherein said decorative covering comprises a material selected from the group consisting of wood, plastic, wood composite, cloth and paint.

10. The interior window covering frame assembly of claim 7, wherein said window covering comprises a shutter.

11. An interior window covering frame system comprising:

a windowpane generally positioned within an opening of a wall in a first plane;

an interior facing wall surface having a second plane that is substantially parallel to the first plane of the windowpane;

an elongate core substrate comprising a lateral plate and a flange perpendicularly coupled to said lateral plate, the flange intersecting said lateral plate to provide a first portion and a second portion to provide a cross-sectional t-shape, wherein the first and second portions are generally in the same plane, and wherein said lateral plate is directly coupled to said interior facing wall surface in the second plane, and wherein said flange extends outwardly from the lateral plate in a third plane that is substantially perpendicular to both the first plane and the second plane, the elongate core substrate having a thickness of less than 5/16 inch and comprising at least one material having an elastic modulus greater than 2.3 E;

a connecting channel forming a portion of said elongate core substrate;

a window covering directly coupled to said flange, wherein said window covering is capable of substantially covering said windowpane; and a decorative covering directly coupled to said elongate core substrate.

12. The interior window covering frame system of claim 11, wherein said elongate core substrate comprises a material selected from the group consisting of fiberglass, metal, graphite and reinforced plastic.

13. The interior window covering frame system of claim 11, wherein said decorative covering comprises a material selected from the group consisting of wood, plastic, wood composite, cloth and paint.

14. The interior window covering frame system of claim 11, wherein said window covering comprises a shutter.

15. A method for anchoring an interior window covering to a wall having a window opening into which is positioned a windowpane having a window surface in a first plane, said method comprising:

providing a frame substrate that comprises a thickness of less than 5/16 inch and has, by volume, an elastic modulus greater than wood, and wherein said substrate further comprises a lateral plate and a flange perpendicularly coupled to said lateral plate, the flange dividing the lateral plate into a first portion and a second portion, wherein the first and second portions are generally in the same plane;

coupling said lateral plate of said frame substrate to an interior facing surface of said wall, said interior facing surface having a second plane that is generally parallel to the first plane of the windowpane, wherein said flange extends outwardly from said lateral plate in a third plane that is substantially perpendicular to both said first plane and said second plane, and wherein said flange includes a mounting surface to receive a hinge attached to said interior window covering, said interior window covering being capable of substantially covering said windowpane;

using a connecting channel to directly interconnect a first portion of said frame substrate to a second portion of said frame substrate;

directly coupling a decorative covering to said frame substrate; and directly coupling said hinge of said interior window covering to said flange.

* * * * *